US006266507B1

(12) United States Patent
Nagahama et al.

(10) Patent No.: US 6,266,507 B1
(45) Date of Patent: Jul. 24, 2001

(54) DEVELOPING DEVICE HAVING LOW TURBULENCE DEVELOPER FLOW

(75) Inventors: Hitoshi Nagahama, Uji; Katsuaki Sumida, Kashiba; Toshio Nishino, Yamatokoriyama, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/393,158

(22) Filed: Sep. 10, 1999

(30) Foreign Application Priority Data

Sep. 28, 1998 (JP) ..... 10-273240

(51) Int. Cl.[7] ..... G03G 15/09
(52) U.S. Cl. ..... 399/274; 399/267
(58) Field of Search ..... 399/267, 275, 399/277, 282, 272, 273, 274; 430/111

(56) References Cited

U.S. PATENT DOCUMENTS

| | | | | |
|---|---|---|---|---|
| 4,149,488 | * | 4/1979 | Baier | 399/275 X |
| 4,637,706 | * | 1/1987 | Hosoi et al. | 399/275 |
| 4,660,958 | * | 4/1987 | Egami et al. | 399/275 X |
| 4,705,383 | * | 11/1987 | Hiraga et al. | 399/275 |
| 4,774,543 | * | 9/1988 | Yoshikawa et al. | 399/267 X |
| 5,781,836 | * | 7/1998 | Tada et al. | 399/275 |
| 5,824,446 | * | 10/1998 | Nishihara et al. | 430/111 X |
| 5,946,530 | | 8/1999 | Tsuji et al. . | |
| 6,021,295 | * | 2/2000 | Ochiai et al. | 399/275 |
| 6,078,768 | * | 6/2000 | Suzuki | 399/267 X |

FOREIGN PATENT DOCUMENTS

| | | |
|---|---|---|
| 3-71166 | 3/1991 | (JP) . |
| 5-289523 | 11/1993 | (JP) . |
| 6-33158 | 4/1994 | (JP) . |
| 6-194962 | 7/1994 | (JP) . |
| 10-104923 | 4/1998 | (JP) . |

* cited by examiner

*Primary Examiner*—Susan S. Y. Lee

(57) ABSTRACT

A developing device includes: a multiple number of magnetic poles fixed at predetermined positions; a developer sleeve which rotatably encloses the magnetic poles; a doctor blade for regulating the thickness of the developer layer on the developer sleeve; and an agitating roller arranged adjacent to the developer sleeve and agitating and supplying the developer. In this arrangement, the magnetic poles include a development magnetic pole for developing the static latent image on the photoreceptor drum, and a developer conveyance magnetic pole positioned downstream, with resect to the rotational direction of the developer sleeve, of the development magnetic pole. A magnetic element is arranged opposing the developer sleeve outside the developer flow path where the magnetic field of the developer conveyance pole is not effective.

20 Claims, 12 Drawing Sheets

FIG. 6

| | Image density | Fog density | Developer circulation evaluation (toner concentration %) | | | | Toner Aggre-gation | Toner filming over developer sleeve | Toner filming over carrier surface | Adherence of external additives over toner surface | Total evaluation |
|---|---|---|---|---|---|---|---|---|---|---|---|
| | | | Developer Sleeve surface A | Agitated portion B | A-B | Evalu-ation | | | | | |
| Mode 1 | 1.45-1.40 | 0.20-0.05 | 7.0 | 7.0 | 0.0 | Good | Good | Good | Good | Good | Good |
| Mode 2 | 1.43-1.40 | 0.22-0.10 | 6.9 | 6.9 | 0.0 | Good | Good | Good | Good | Good | Good |
| Mode 3 | 1.43-1.39 | 0.38-0.18 | 6.5 | 6.9 | -0.4 | Good | Good | Good | Good | Good | Good |
| Mode 4 | 1.41-1.38 | 0.47-0.20 | 6.7 | 6.9 | -0.2 | Good | Good | Good | Good | Good | Good |
| Comp.Ex.1 | 1.00-0.72 | 1.20-0.98 | 5.8 | 6.9 | -1.1 | Bad | Bad | Medium | Bad | Medium | Bad |
| Comp.Ex.2 | 0.85-0.58 | 1.02-0.76 | 6.2 | 7.0 | -0.8 | Medium | Medium | Medium | Medium | Medium | Medium |
| Comp.Ex.3 | 1.43-1.40 | 1.45-1.23 | 4.9 | 7.0 | -2.1 | Bad | Bad | Bad | Bad | Bad | Bad |

* Evaluation criteria
1.35≤Allowable image density
0.50≥Allowable fog density
A-B:Good<0.5<Medium<1.0<Bad

FIG. 13

| | Image density | Fog density | Developer circulation evaluation (toner concentration %) | | | | Toner Aggre-gation | Toner filming over developer sleeve | Toner filming over carrier surface | Adherence of external additives over toner surface | Total evaluation |
|---|---|---|---|---|---|---|---|---|---|---|---|
| | | | Developer Sleeve surface A | Agitated portion B | A-B | Evalu-ation | | | | | |
| Mode 1 | 1.45-1.40 | 0.22-0.05 | 7.0 | 7.0 | 0.0 | Good | Good | Good | Good | Good | Good |
| Mode 2 | 1.41-1.35 | 0.22-0.10 | 6.9 | 6.9 | 0.0 | Good | Good | Good | Good | Good | Good |
| Comp.Ex.1 | 1.33-1.01 | 1.45-1.09 | 5.7 | 7.0 | -1.3 | Bad | Bad | Bad | Bad | Bad | Bad |
| Comp.Ex.2 | 0.85-0.58 | 1.03-0.67 | 6.0 | 6.9 | -0.9 | Medium | Medium | Medium | Bad | Medium | Medium |

* Evaluation criteria
1.35≤Allowable image density
0.50≥Allowable fog density
A-B:Good<0.5<Medium<1.0<Bad

FIG.20

| | Mean carrier diameter D50(μm) 30-80 | Image density | Fog density | Developer circulation evaluation (toner concentration %) | | | | Toner Aggre-gation | Toner filming over developer sleeve | Toner filming over carrier surface | Adherence of external additives over toner surface | Total evaluation |
|---|---|---|---|---|---|---|---|---|---|---|---|---|
| | | | | Developer Sleeve surface A | Agitated portion B | A-B | Evalu-ation | | | | | |
| Mode 1-1 | 37 | 1.39-1.35 | 0.20-0.05 | 6.6 | 7.0 | -0.4 | Good | Good | Good | Good | Good | Good |
| Mode 1-2 | 60 | 1.45-1.41 | 0.31-0.18 | 6.8 | 7.0 | -0.2 | Good | Good | Good | Good | Good | Good |
| Mode 2 | 60 | 1.43-1.40 | 0.22-0.10 | 6.8 | 6.9 | -0.1 | Good | Good | Good | Good | Good | Good |
| Mode 3 | 80 | 1.46-1.44 | 0.22-0.18 | 7.0 | 7.0 | 0.0 | Good | Good | Good | Good | Good | Good |
| Mode 4 | 37 | 1.38-1.35 | 0.35-0.20 | 6.4 | 6.8 | -0.4 | Good | Good | Good | Good | Good | Good |
| Comp.Ex.1-1 | 37 | 0.85-0.66 | 0.48-0.40 | 4.9 | 6.9 | -2.1 | Bad | Bad | Bad | Bad | Bad | Bad |
| Comp.Ex.1-2 | 80 | 1.07-0.72 | 1.10-0.88 | 6.0 | 6.9 | -0.9 | Medium | Medium | Medium | Medium | Medium | Medium |
| Comp.Ex.2 | 80 | 0.99-0.77 | 0.39-0.33 | 5.7 | 6.8 | -1.1 | Bad | Bad | Medium | Medium | Medium | Bad |
| Comp.Ex.3 | 80 | 0.89-0.58 | 1.45-1.23 | 5.6 | 7.0 | -1.4 | Bad | Bad | Bad | Bad | Bad | Bad |
| Comp.Ex.4 | 32 | 1.33-1.19 | 0.52-0.43 | 6.1 | 7.0 | -0.9 | Medium | Medium | Medium | Medium | Medium | Medium |

* Evaluation criteria
1.35≤Allowable image density
0.50≥Allowable fog density
A-B:Good<0.5<Medium<1.0<Bad

FIG.24

| | Retention Force (Oe) | Image density | Fog density | Developer circulation evaluation (toner concentration %) | | | | Toner Aggre-gation | Toner filming over developer sleeve | Toner filming over carrier surface | Adherence of external additives over toner surface | Total evaluation |
|---|---|---|---|---|---|---|---|---|---|---|---|---|
| | | | | Developer Sleeve surface A | Agitated portion B | A-B | Evalu-ation | | | | | |
| Mode 1-1 | 16 | 1.45-1.40 | 0.20-0.05 | 7.0 | 7.0 | 0.0 | Good | Good | Good | Good | Good | Good |
| Mode 1-2 | 30 | 1.39-1.35 | 0.31-0.18 | 6.7 | 7.0 | -0.3 | Good | Good | Good | Good | Good | Good |
| Mode 2 | 16 | 1.43-1.40 | 0.22-0.10 | 6.9 | 6.9 | 0.0 | Good | Good | Good | Good | Good | Good |
| Mode 3 | 25 | 1.43-1.37 | 0.22-0.20 | 6.7 | 6.9 | -0.2 | Good | Good | Good | Good | Good | Good |
| Mode 4 | 30 | 1.41-1.36 | 0.48-0.18 | 6.6 | 7.0 | -0.4 | Good | Good | Good | Good | Good | Good |
| Comp.Ex.1-1 | 8 | 1.41-1.35 | 0.48-0.40 | 6.4 | 7.0 | -0.6 | Medium | Medium | Medium | Medium | Medium | Medium |
| Comp.Ex.1-2 | 16 | 1.07-0.72 | 1.10-0.88 | 5.8 | 6.9 | -1.1 | Bad | Bad | Bad | Medium | Medium | Bad |
| Comp.Ex.2 | 16 | 0.85-0.58 | 1.00-0.71 | 5.7 | 6.8 | -1.1 | Bad | Bad | Bad | Medium | Bad | Bad |
| Comp.Ex.3 | 30 | 1.03-0.53 | 1.45-1.23 | 4.9 | 7.0 | -2.1 | Bad | Bad | Bad | Bad | Bad | Bad |
| Comp.Ex.4 | 41 | 1.30-1.89 | 0.99-0.76 | 6.1 | 7.0 | -0.9 | Medium | Medium | Medium | Medium | Medium | Medium |

* Evaluation criteria
1.35≤Allowable image density
0.50≥Allowable fog density
A-B:Good<0.5<Medium<1.0<Bad

DEVELOPING DEVICE HAVING LOW TURBULENCE DEVELOPER FLOW

BACKGROUND OF THE INVENTION (1) Field of the Invention

The present invention relates to a developing device which performs development of the static latent image formed on the static latent image bearer, by rotating a developer support that incorporates a magnetic field forming means having multiple magnetic poles fixed at predetermined positions and that supports a developer thereon so as to supply the static latent image with the developer.

(2) Description of the Prior Art

When a dual-component developer is used, toner concentration unevenness will occur in the dual-component developer layer after development of a static latent image in the developing area. To deal with this, in a conventional developing device for dual-component developer, two magnetic poles, namely the first and second poles, of a similar polarity are arranged adjacent to each other inside the developer sleeve using fixed magnets, on the downstream side of the developing portion with respect to the rotational direction of the developer sleeve, so that a repulsive magnetic field formed by these two magnetic poles will remove the developer from the developer sleeve. The thus removed developer is agitated by a rotational agitator disposed in the repulsive magnetic field to make the toner concentration uniform, and then the developer with the toner density made uniform is conveyed by the rotating agitator to the developer sleeve on its second magnetic pole side. Thus, the density unevenness in the developed image due to development hysteresis can be prevented.

However, under the formation of a repulsive magnetic field alone, it is not possible to completely remove the developer from the developer sleeve, so some part of the developer is conveyed whilst adhering to the developer sleeve, from the first magnetic pole side to the second magnetic side. Particularly, when the toner is a micro particle toner and/or the magnetic carrier is a micro particle carrier, the tribo-charge amount on the developer per unit weight becomes relatively large so that the developer adheres to the developer sleeve with a greater electrostatic attraction. Therefore, it is difficult for the repulsive magnetic field to fully remove the developer from the developer sleeve.

So that, when the developer having passed through the developing area cannot be removed from the developer sleeve and hence re-enter the developing area, the developed image may have density unevenness and cannot offer a high, fine quality. Further there is the problem in that if the developing device has been run for a long period of time without the developer fully removed from the developer sleeve, degradation of the developer is accelerated causing density lowering and background fogging in the developed image.

As countermeasures against these problems, for example, Japanese Patent Application Laid-Open Hei 6 No.194962 has offered a method in which the developer is removed from the developer support by using a magnetic brush formed between the developer support and the magnetic element, by providing a magnetic element in the developer flow path under the influence of a repulsive magnetic field. Another method has been also proposed in Japanese Patent Application Laid-Open Hei 5 No.289523, in which the developer is removed from the developer support by providing a cleaning member in the developer flow path in the repulsive magnetic field so that the cleaning member comes into frictional contact with the developer support.

However, a small-diametric developer sleeve configuration in combination with the scheme of Japanese Patent Application Laid-Open Hei 6 No.194962 where the removal of the developer is performed by using lowering of the developer support's retention force by formation of a repulsive magnetic field, has a disadvantage in terms of cost because the fixed magnets incorporated in the developer sleeve need to be magnetized with a high precision.

Further, provision of a magnetic element or a cleaning member in the developer flow path will disturb the flowing state of the developer in the developing hopper, inducing a high risk of degradation of the image quality. In particular, in the illustration of Japanese Patent Application Laid-Open Hei 6 No.194962, the magnetic element is located between the developer sleeve and rotational agitator. However, originally the developer conveyance pressure and the toner concentration are high at this point, so that the conveyance pressure is further increased if a magnetic element is laid out in such a position, which may possibly cause problems of toner aggregation, toner filming over the developer sleeve surface and/or spent toner.

Moreover, the arrangement of a cleaning member in direct and frictional contact with the developer support surface, produces excessive stress on the developer, which may result in increasing of the driving torque and heat generation of the developing unit.

SUMMARY OF THE INVENTION

It is therefore an object of the present invention to provide a developing device, which can prevent the occurrence of turbulence of the developer flow accompanied by addition of extra elements in the developer hopper and which will not cause excessive stress on the developer and/or the developing device and hence is free from the problems of toner aggregation, sleeve filming, spent toner etc., and wherein the developer in the developing hopper can be smoothly circulated by achieving easy removal of the developer after development from the developer sleeve and easy supplying of the developer thus removed to the rotational agitator.

In order to achieve the above object, the present invention is configured as follows:

In accordance with the first aspect of the present invention, a developing device includes:

a magnetic field forming means having multiple number of magnetic poles fixed at predetermined positions;

a developer support which rotatably encloses the magnetic field forming means for conveying the developer whilst supporting it on the surface thereof by magnetism of the magnetic field forming means;

a regulating element for regulating the thickness of the developer layer supported on the developer support surface; and a rotational agitating means which is disposed adjacent to the developer support and receives the developer from the developer support and supplies the developer to the surface of the developer support, wherein the developer support, as it rotates, supplies and develops the static latent image on a static latent image bearer with the developer supported on the developer support, and is characterized in that a magnetic element is arranged opposing the developer support and outside the developer flow path.

In accordance with the second aspect of the present invention, the developing device having the above first feature is characterized in that the longitudinal dimension, perpendicular to the developer conveying direction, of the magnetic element is almost equal to, or shorter than, the magnetized width of the developer conveyance magnetic pole of the magnetic field forming means.

In accordance with the third aspect of the present invention, the developing device having the above first feature is characterized in that the magnetic element is arranged out of the influence of the magnetic field of the development magnetic pole of the magnetic field forming means.

In accordance with the fourth aspect of the present invention, the developing device having the above first feature is characterized in that the magnetic element is arranged out of contact with the developer circulating inside the developing device.

In accordance with the fifth aspect of the invention, a developing device includes:

a magnetic field forming means having multiple number of magnetic poles fixed at predetermined positions;

a developer support which rotatably encloses the magnetic field forming means for conveying the developer whilst supporting it on the surface thereof by magnetism of the magnetic field forming means;

a regulating element for regulating the thickness of the developer layer supported on the developer support surface; and a rotational agitating means which is disposed adjacent to the developer support and receives the developer from the developer support and supplies the developer to the surface of the developer support, wherein the developer support, as it rotates, supplies and develops the static latent image on a static latent image bearer with the developer supported on the developer support, and is characterized in that the magnetic field forming means has a pair of magnetic poles of the same polarity forming a repulsive magnetic field on the downstream side, with respect to the rotating direction of the developer support, of the developing position for developing the static latent image on the static latent image bearer, and a magnetic element is arranged opposing the developer support.

In accordance with the sixth aspect of the present invention, the developing device having the above first feature is characterized in that the developer is a dual-component magnetic developer composed of a toner and magnetic carrier having a carrier particle size ranging from 37 to 80 $\mu$m.

In accordance with the seventh aspect of the present invention, the developing device having the above fifth feature is characterized in that the developer is a dual-component magnetic developer composed of a toner and magnetic carrier having a carrier particle size ranging from 37 to 80 $\mu$m.

In accordance with the eighth aspect of the present invention, the developing device having the above first feature is characterized in that the developer is a magnetic developer having a retention force Hc of 10 to 30 Oe under the presence of an external magnetic field of 5 KOe.

In accordance with the ninth aspect of the present invention, the developing device having the above fifth feature is characterized in that the developer is a magnetic developer having a retention force Hc of 10 to 30 Oe under the presence of an external magnetic field of 5 KOe.

BRIEF DESCRIPTION OF THE DRAWINGS

FIG. 6 is an illustrative chart showing the results of the print endurance test as to the developing devices of the first embodiment of the present invention;

FIG. 13 is an illustrative chart showing the results of the print endurance test as to the developing devices of the second embodiment of the present invention;

FIG. 20 is an illustrative chart showing the results of the print endurance test as to the developing devices of the third embodiment of the present invention;

FIG. 24 is an illustrative chart showing the results of the print endurance test as to the developing devices of the fourth embodiment of the present invention.

DESCRIPTION OF THE PREFERRED EMBODIMENTS (The first embodiment)

Figure 1:
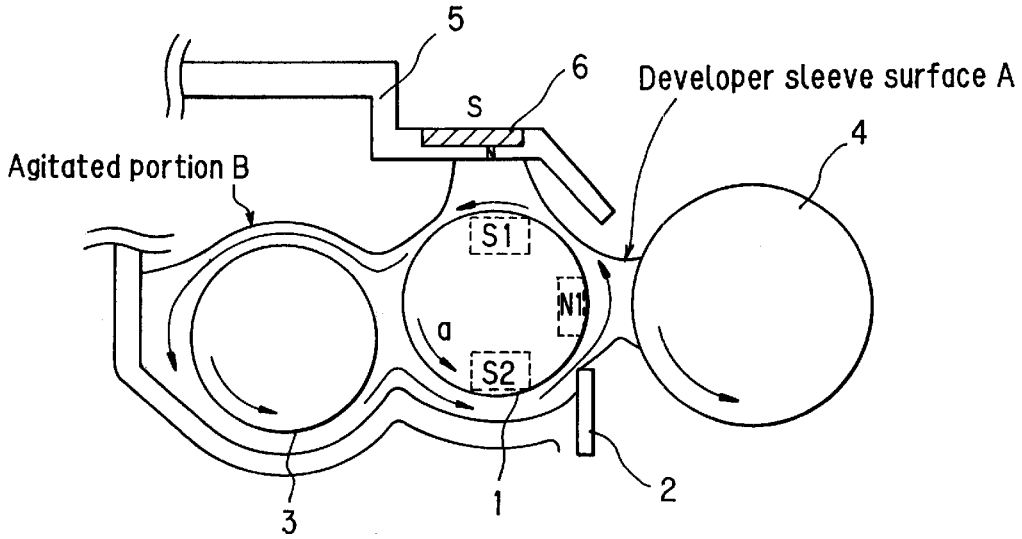
FIG. 1 is a sectional view showing mode 1 of the first embodiment of a developing device of the present invention.

The overall configuration of the first mode (mode 1) of the first embodiment of a developing device of the present invention will be described with reference to FIG. 1.

This developing device includes: fixed magnets as a magnetic field forming means having multiple number of magnetic poles fixed at predetermined positions; a developer sleeve 1 as a developer support which rotatably encloses the fixed magnets so as to convey the developer whilst supporting it on the surface thereof by magnetism of the fixed magnets; a doctor blade 2 as a regulating element for regulating the thickness of the developer layer supported on the surface of developer sleeve 1; and an agitating roller 3 as a rotational agitating means which is disposed adjacent to developer sleeve 1 and receives the developer from developer sleeve 1 and supplies the developer to the surface of developer sleeve 1.

The developer supported on developer sleeve 1 is supplied by the rotation of developer sleeve 1 to a photoreceptor drum 4 as an electrostatic latent image bearer so that the static latent image formed on the drum is developed with the developer.

The fixed magnets inside developer sleeve 1 include: a development magnetic pole N1 disposed at a position for supplying the static latent image on photoreceptor drum 4 with the developer from developer sleeve 1 so as to develop it; a collecting magnetic pole S1 disposed downstream of development magnetic pole N1 with respect to the rotational direction 'a' of developer sleeve 1; and a conveyance magnetic pole S2 disposed upstream of development magnetic pole N1 with respect to the rotational direction 'a' of developer sleeve 1.

Disposed opposing collecting magnetic pole S1 is a casing 5 of the developing device which integrally has a magnetic element 6 disposed on the outer side thereof but present within the magnetic field of collecting magnetic pole S1 so as to form a magnetic field directed approximately vertically between itself and collecting magnetic pole S1. This magnetic element 6 may be one having magnetic poles by itself such as a solid magnet, a plastic magnet containing a magnetic powder, a magnetized metal etc., or may be a magnetic material such as iron, nickel or other metals, or plastic containing a magnetic powder, etc. which is magnetized by the magnetism of the conveyance magnetic pole.

In the above developing device, the developer which has been tribo-electrified by the agitation of agitating roller 3 and conveyed thereby becomes supported on the surface of developer sleeve 1 at the position of conveyance magnetic pole S2 and is then regulated by a doctor blade 2 to the optimal thickness. The thus regulated developer is conveyed to the developing position where it develops the static latent image on the surface of photoreceptor drum 4 into a visual image.

By the development, the distribution of the developer on the surface of developer sleeve 1 becomes uneven correspondingly to the developed image (the developer corresponding to the static latent image has transferred to photoreceptor drum 4 so the developer remaining on the surface of developer sleeve 1 becomes uneven). This developer having the uneven distribution corresponding to the developed image is conveyed to the position of collecting magnetic pole S1 by the rotation of developer sleeve 1.

Since magnetic element 6 is provided at the position opposing collecting magnetic pole S1, the developer is removed from the surface of developer sleeve 1 by the magnetic field formed between collecting magnetic pole S1 and magnetic element 6.

That is, since the aforementioned magnetic field acts approximately perpendicular to the developer conveying direction of the surface of the developer sleeve 1, this generates a speed differential within the moving developer layer.

As a result, the developer can be agitated in the direction at right angles with the developer conveying direction so as to promote the removal of the developer from the developer sleeve 1 surface.

The above configuration having no use of a repulsive magnetic field for removal of the developer, makes it possible to suppress the cost increase because no high accuracy magnetization is needed unlike the conventional configuration where two adjacent magnetic poles of the same polarity need to be arranged on the downstream side of development magnetic pole N1. Further, as the above magnetic element 6 is not one that is arranged within the developer flow path, there is neither the possibility of the developer flowing in the developing hopper of the developing device being agitated nor of the developer being excessively stressed.

Though magnetic element 6 is arranged only in the position opposing collecting magnetic pole S1 in the above configuration, this should not limit this embodiment. For example, other than the above location opposing collecting magnetic pole S1, the magnetic element may be disposed at a position either upstream or downstream of the position opposing collecting magnetic roller S1 with respect to the rotational direction of developer sleeve 1. Alternatively, two magnetic elements may be disposed both upstream and downstream of the above position.

Figure 2:
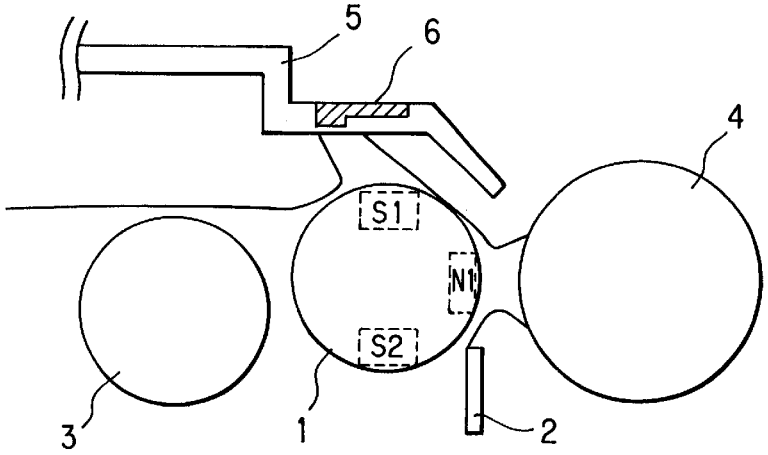
FIG. 2 is a sectional view showing mode 2 of the first embodiment of a developing device of the present invention.

Next, the second mode (mode 2) of the first embodiment of a developing device of the present invention will be described with reference to FIG. 2.

This is a variational arrangement of magnetic element 6 of mode 1 of the first embodiment. As shown in FIG. 2, in order to enhance the magnetic field on the downstream side of magnetic element 6 with respect to the rotational direction 'a' of developer sleeve 1, magnetic element 6 is formed greater in thickness on the downstream side of the rotational direction.

Figure 3:
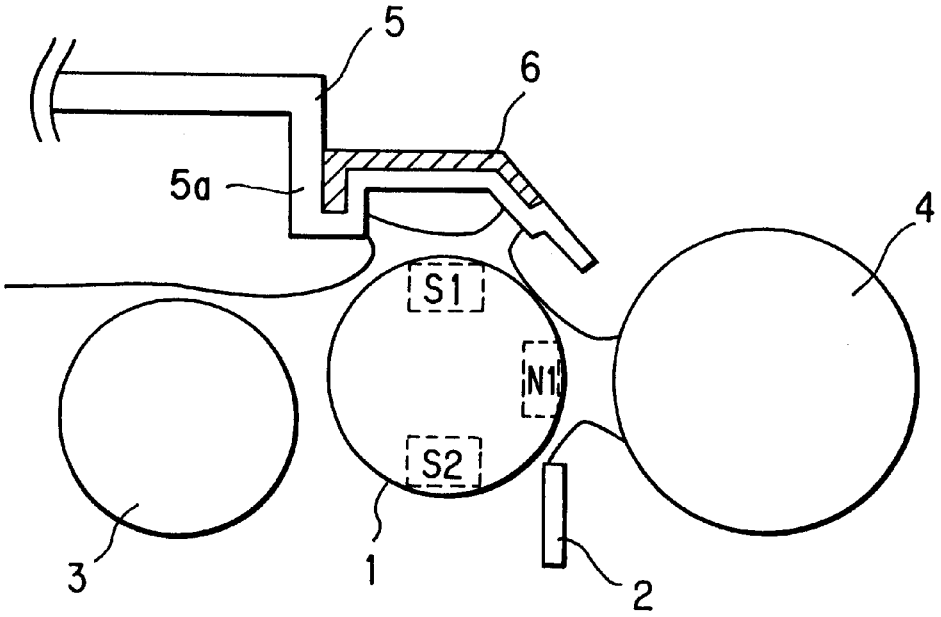
FIG. 3 is a sectional view showing mode 3 of the first embodiment of a developing device of the present invention.

The third mode (mode 3) of the first embodiment of a developing device of the present invention will be described with reference to FIG. 3.

Mode 3 of the first embodiment is a variational arrangement of magnetic element 6 of mode 1 of the first embodiment. As shown in FIG. 3, the upstream end of magnetic element 6 with respect to the rotational direction 'a' of developer sleeve 1 is extended up to a position within the magnetic field of collecting magnetic pole S1 but out of the influence of the magnetic field of development magnetic pole N1 while magnetic element 6 is extended downstream with respect to the rotational direction 'a' with its end bent so as to fit into a groove 5*a* which is recessed inwardly into casing 5.

Figure 4:
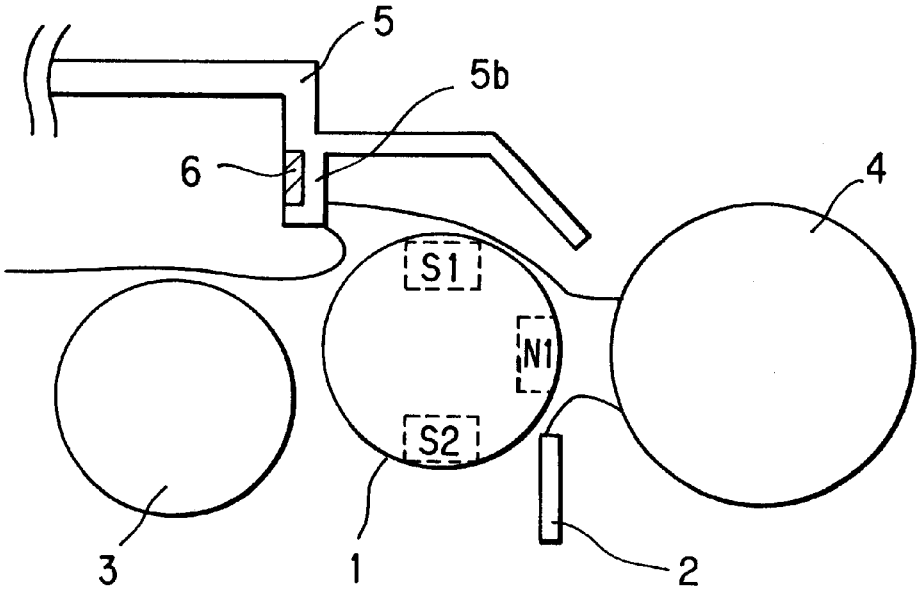
FIG. 4 is a sectional view showing mode 4 of the first embodiment of a developing device of the present invention.

The fourth mode (mode 4) of the first embodiment of a developing device of the present invention will be described with reference to FIG. 4.

Mode 4 of the first embodiment is a variational arrangement of magnetic element 6 of mode 3 of the first embodiment. As shown in FIG. 4, a projected portion 5*b* projected toward developer sleeve 1 is formed in casing 5 at its downstream side with respect to the rotational direction 'a' of developer sleeve 1, within the magnetic field of collecting magnetic pole S1 so that a magnetic element 6 is arranged on the surface of projected portion 5*b* facing agitating roller 3.

Figure 5:
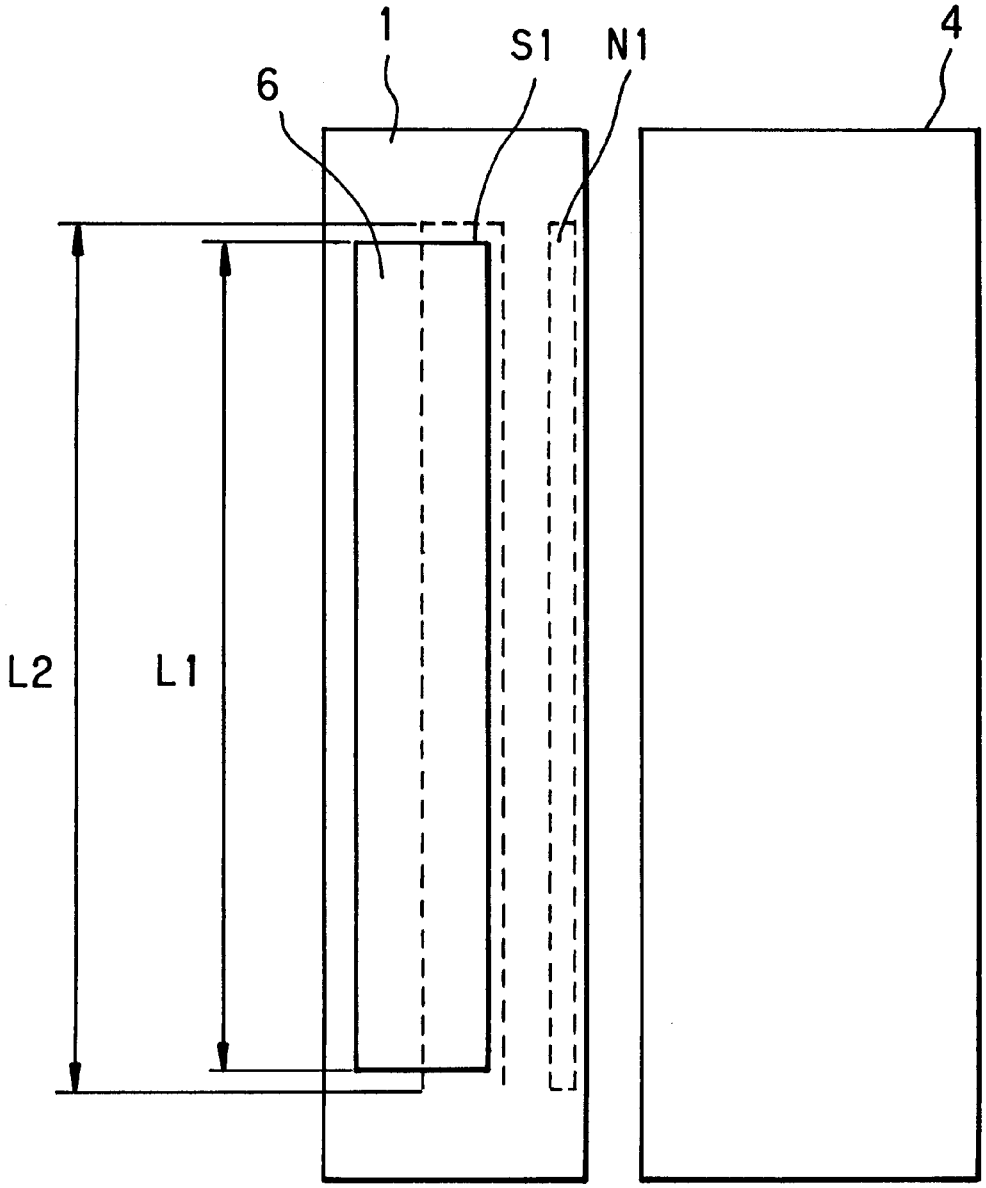
FIG. 5 is a plan view showing the first embodiment of a developing device of the present invention.

In the above modes 1 to 4 of the first embodiment, the longitudinal dimension L1 of magnetic element 6 is almost equal to, or shorter than, the magnetized width L2 of developer sleeve 1 as shown in FIG. 5.

This is to prevent the developer from entering the bearing portions. Specifically, if the longitudinal dimension L1 of magnetic element 6 is greater than the magnetized width L2 of developer sleeve 1, the developer can enter the bearing portions at the ends of developer sleeve 1 going beyond the magnetized area of developer conveyance magnetic pole S2, producing risks of toner aggregation, toner scatter, developer dropping, developer sleeve 1 being stuck and the like, The developing devices of modes 1 to 4 of the first embodiment were set to an image forming apparatus (a digital copier AL-1000: a product of Sharp Kabushiki Kaisha) and were tested as to printing endurance and the evaluation result of the test is shown in FIG. 6.

In the print endurance test shown in FIG. 6, the image density was measured by a PROCESS MEASUREMENTS RD914, a product of Macbeth Corporation and the fogging density was measured by a Color Meter ZE2000, a product of NIPPON DENSHOKU INDUSTRIES CO., LTD. The table in FIG. 6 shows these measurements, evaluation of the developer's circulation performance (removal performance of the developer from the developer sleeve), toner aggregation, toner filming over the developer sleeve and the adherence of external additives in the toner.

The evaluation of the developer's circulation performance was evaluated by the difference in toner concentration between the developer sleeve and the agitated portion of the agitating roller (the toner concentration on the developer sleeve will lower when circulation is poor).

Toner aggregation was evaluated by observing the sampled developer using a commercially available electron microscope: 'good' represents no toner aggregation; 'medium' represents the presence of two-fold to five-fold aggregations of toner particles; and 'bad' represents the presence of five-fold or greater aggregations of toner particles.

Toner filming over the developer sleeve was evaluated by visual observation of the developer sleeve surface: 'good' represents no filming; 'medium' represents the presence of thin striped toner adherence; and 'bad' represents obvious presence of fused toner adherence.

Toner filming on the carrier surface was evaluated by measuring the carbon content in the carrier which was obtained by removing the toner from the developer, using a Carbon Analyzer EMIA-110, a product of HORIBA, Ltd.: 'good' represents no filming (0% carbon content); 'medium' represents the carbon content equivalent to a toner concentration of 1.0%; and 'bad' represents a carbon content equivalent to a toner concentration of greater than 1.0%.

The adherence of the external toner additives was evaluated by observing the toner surface of the sampled developer using a commercially available electron microscope: 'good' represents no change from the state of external additives adhering on the toner before agitation; 'medium' represents reduction of external additive particles adhering on the toner by 10 to 30% in number from the state before agitation; and 'bad' represents reduction of external additive particles adhering on the toner by 30% or greater in number from the state before agitation, or presence of external additive particles embedded into the toner.

Figure 7:
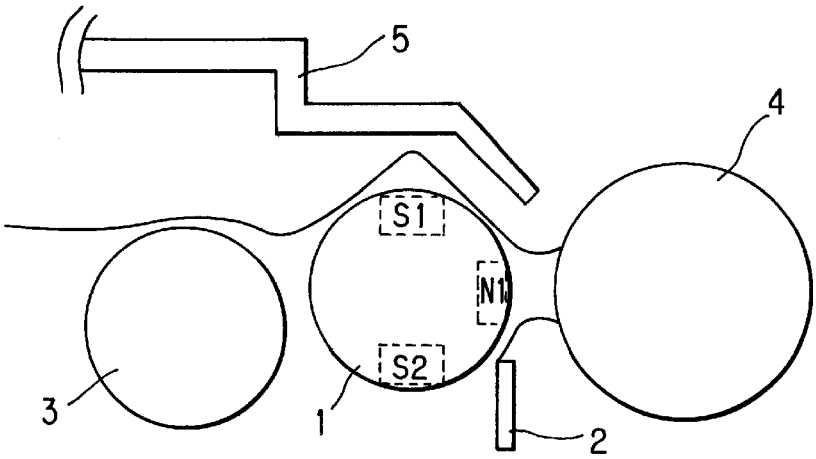
FIG. 7 is a sectional view showing a comparative example 1 compared to the first embodiment of a developing device of the present invention.
Figure 8:
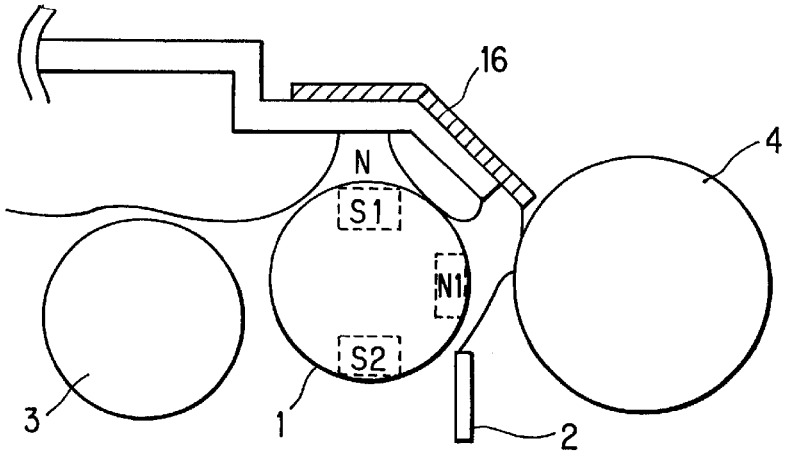
FIG. 8 is a sectional view showing a comparative example 2 compared to the first embodiment of a developing device of the present invention.
Figure 9:
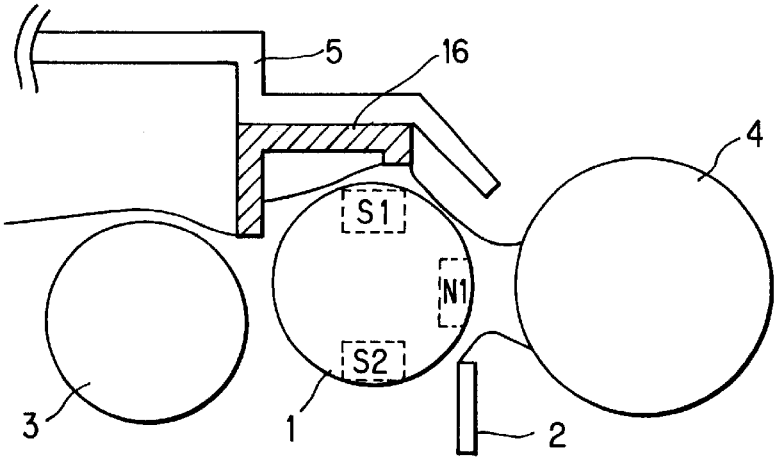
FIG. 9 is a sectional view showing a comparative example 3 compared to the first embodiment of a developing device of the present invention.

Comparative examples 1 to 3 in FIG. 6 are examples to be compared to modes 1 to 4 of the first embodiment. Comparative example 1 is a configuration shown in FIG. 7 having no magnetic element; comparative example 2 is a configuration shown in FIG. 8 having a magnetic element 16 with its upstream end, with respect to the rotational direction of developer sleeve 1, extended to the proximity of photoreceptor drum 4 where the magnetic field of development magnetic pole N1 is effective; and comparative example 3 is a configuration shown in FIG. 9 where a magnetic element 16 has its upstream end, with respect to the rotational direction of developer sleeve 1, extended toward developer sleeve 1 surface and its downstream end extended to a position inside the developer flow path where developer sleeve 1 and agitating roller 3 oppose each other.

As understood from FIG. 6, all modes 1 to 4 of the first embodiment presented beneficial results, whereas comparative examples 1 to 3 had the problems of toner density lowering, toner aggregation, toner filming and/or adherence of external additives onto the toner surface.

(The second embodiment)

Figure 10:
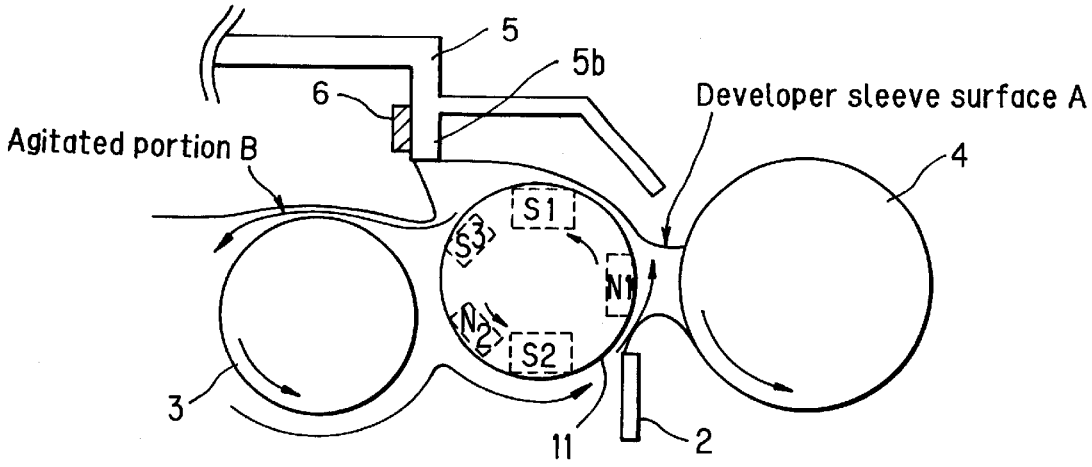
FIG. 10 is a sectional view showing mode 1 of the second embodiment of a developing device of the present invention.

The overall configuration of the first mode (mode 1) of the second embodiment of a developing device of the present invention will be described with reference to FIG. 10.

This developing device includes: fixed magnets as a magnetic field forming means having multiple number of magnetic poles fixed at predetermined positions; a developer sleeve 11 as a developer support which rotatably encloses the fixed magnets so as to convey the developer whilst supporting it on the surface thereof by magnetism of the fixed magnets; a doctor blade 2 as a regulating element for regulating the thickness of the developer layer supported on the surface of developer sleeve 11; and an agitating roller 3 as a rotational agitating means which is disposed adjacent to developer sleeve 11 and receives the developer from developer sleeve 11 and supplies the developer to the surface of developer sleeve 11.

The developer supported on developer sleeve 11 is supplied by the rotation of developer sleeve 11 to a photoreceptor drum 4 as an electrostatic latent image bearer so that the static latent image formed on the drum is developed with the developer.

The fixed magnets inside developer sleeve 11 include: a development magnetic pole N1 disposed at a position for supplying the static latent image on photoreceptor drum 4 with the developer from developer sleeve 11 to develop it; a collecting magnetic pole S1 disposed downstream of development magnetic pole N1 with respect to the rotational direction 'a' of developer sleeve 11; a repulsive magnetic pole S3 for forming a repulsive magnetic field together with collecting magnetic pole S1; a conveyance magnetic pole S2 disposed upstream of development magnetic pole N1 with respect to the rotational direction 'a' of developer sleeve 11; and a magnetic pole N2 upstream of conveyance magnetic pole S2.

In this arrangement, a projected portion 5*b* is projected from a casing 5 into the repulsive magnetic field formed between collecting magnetic pole S1 and repulsive magnetic pole S3 on the downstream side of casing 5 with respect to the rotational direction 'a' of developer sleeve 11. A magnetic element 6 is arranged on the surface of projected portion 5*b* facing an agitating roller 3.

Figure 11:
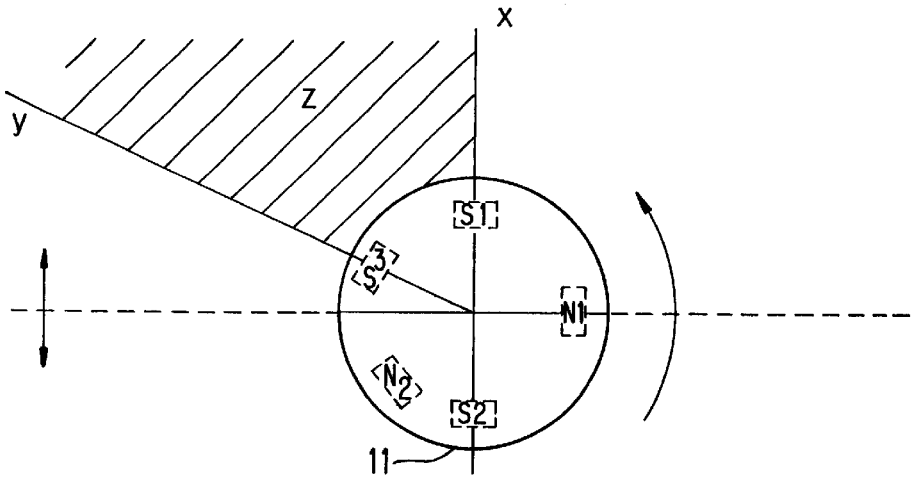
FIG. 11 is an illustration showing the area of exertion of the repulsive magnetic field in the second embodiment of a developing device of the present invention.

As shown in FIG. 11, this magnetic element 6 is arranged within repulsive magnetic field z enclosed by the line x that originates from the center of developer sleeve 11 and passes through collecting magnetic pole S1 and the line y that originates from the center of developer sleeve 11 and passes through repulsive magnetic pole S3.

In the above developing device, the developer which has been tribo-electrified by the agitation of agitating roller 3 and conveyed thereby becomes supported on the surface of developer sleeve 11 at the position of conveyance magnetic pole S2 and is then regulated by doctor blade 2 to the optimal thickness. The thus regulated developer is conveyed to the developing position where it develops the static latent image on the surface of photoreceptor drum 4 into a visual image.

By the development, the distribution of the developer on the surface of developer sleeve 11 becomes uneven correspondingly to the developed image (the developer corresponding to the static latent image has transferred to photoreceptor drum 4 so the developer remaining on the surface of developer sleeve 11 becomes uneven). This developer having uneven distribution corresponding to the image is conveyed to the position of the repulsive magnetic field formed by collecting magnetic pole S1 and repulsive magnetic pole S3 by the rotation of developer sleeve 11.

Since magnetic element 6 is arranged within the repulsive magnetic field while the developer retention force of sleeve 11 is weakened due to the repulsive magnetic field, the developer is removed from the surface of developer sleeve 11 by the magnetic force from magnetic element 6.

That is, since the aforementioned magnetic field acts approximately perpendicular to the developer conveying direction of the surface of the developer sleeve 11, this generates a speed differential within the moving developer layer.

As a result, the developer can be agitated in the direction at right angles with the developer conveying direction so as to promote the removal of the developer from the developer sleeve 11 surface.

In the above arrangement, it is possible to efficiently remove the developer by a synergistic effect of the lowering of the developer retention force due to the repulsive magnetic field and the magnetic force of the magnetic element 6. Further, since the above magnetic element 6 is not one that is arranged within the developer flow path, there is neither the possibility of the developer flowing in the developing hopper of the developing device being agitated nor of the developer being excessively stressed.

Though magnetic element 6 is arranged only in the position opposing collecting magnetic pole S1 in the above configuration, this should not limit this embodiment. For example, other than the above location opposing collecting magnetic pole S1, the magnetic element may be disposed at a position either upstream or downstream of the position opposing collecting magnetic roller S1 with respect to the rotational direction of developer sleeve 11. Alternatively, two magnetic elements may be disposed both upstream and downstream of the above position.

Figure 12:
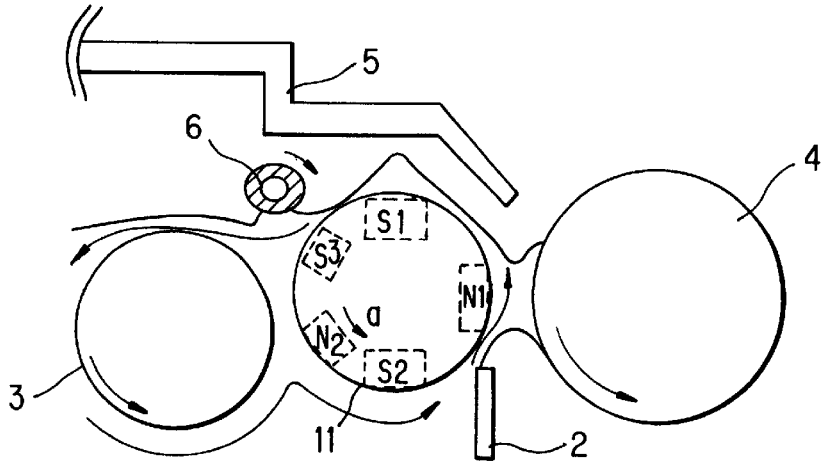
FIG. 12 is a sectional view showing mode 2 of the second embodiment of a developing device of the present invention.

Next, the second mode (mode 2) of the second embodiment of a developing device of the present invention will be described with reference to FIG. 12.

Mode 2 of the second embodiment is a variational arrangement of magnetic element 6 of mode 1 of the second embodiment. As shown in FIG. 12, a cylindrical magnetic element 6 is rotatably arranged in the repulsive magnetic field.

In the above modes 1 and 2 of the second embodiment, the longitudinal dimension L1 of magnetic element 6 is almost equal to, or shorter than, the magnetized width L2 of developer sleeve 11, as in the first embodiment.

The developing devices of modes 1 and 2 of the second embodiment were set to an image forming apparatus (a digital copier AL-1000: a product of Sharp Kabushiki Kaisha) and were tested as to printing endurance and the evaluation results of the test is shown in FIG. 13.

The print endurance test of the second embodiment shown in FIG. 13 was performed in the same manner as in the print endurance test of the first embodiment.

Figure 14:
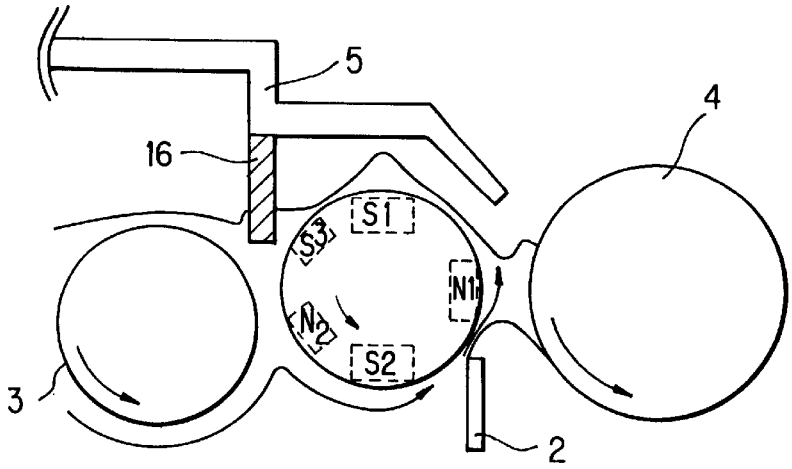
FIG. 14 is a sectional view showing a comparative example 1 compared to the second embodiment of a developing device of the present invention.
Figure 15:
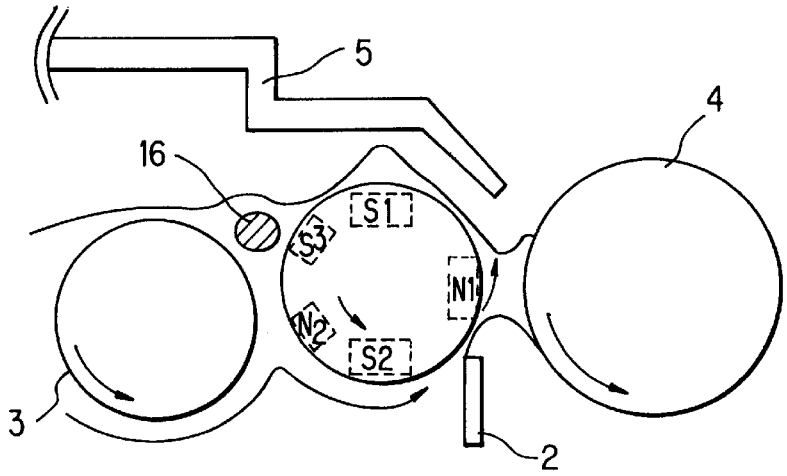
FIG. 15 is a sectional view showing a comparative example 2 compared to the second embodiment of a developing device of the present invention.

Comparative examples 1 and 2 in FIG. 13 are examples to be compared to modes 1 and 2 of the second embodiment. Comparative example 1 is a configuration shown in FIG. 14 where a magnetic element 16 is extended to a position inside the developer flow path where developer sleeve 11 and agitating roller 3 oppose each other. Comparative example 2 is a configuration shown in FIG. 15 where a magnetic element 16 is arranged in the developer flow path between developer sleeve 11 and agitating roller 3.

As understood from FIG. 13, all modes 1 and 2 of the second embodiment presented beneficial results, whereas comparative examples 1 and 2 had the problems of toner density lowering, toner aggregation, toner filming and/or adherence of external additives over the toner surface.

(The third embodiment)

The developing devices of the third embodiment use dual-component magnetic developers containing a carrier having a carrier diameter ranging from 37 to 80 $\mu$m. Various configurations of the developing devices using these dual-component magnetic developers will be described with reference to FIGS. 16 to 19.

Figure 16:
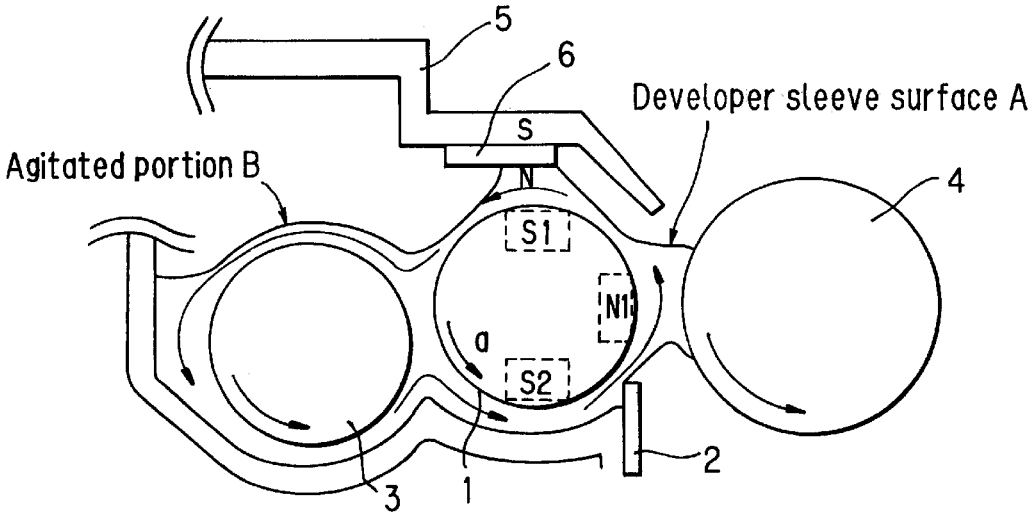
FIG. 16 is a sectional view showing mode 1 of the third embodiment of a developing device of the present invention.
Figure 17:
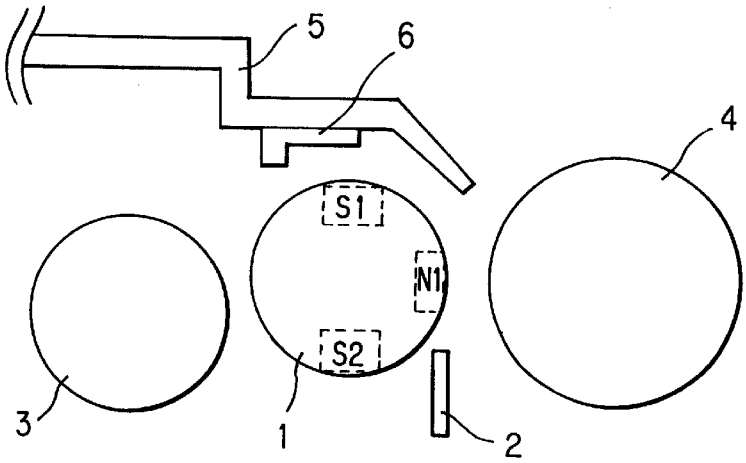
FIG. 17 is a sectional view showing mode 2 of the third embodiment of a developing device of the present invention.
Figure 18:
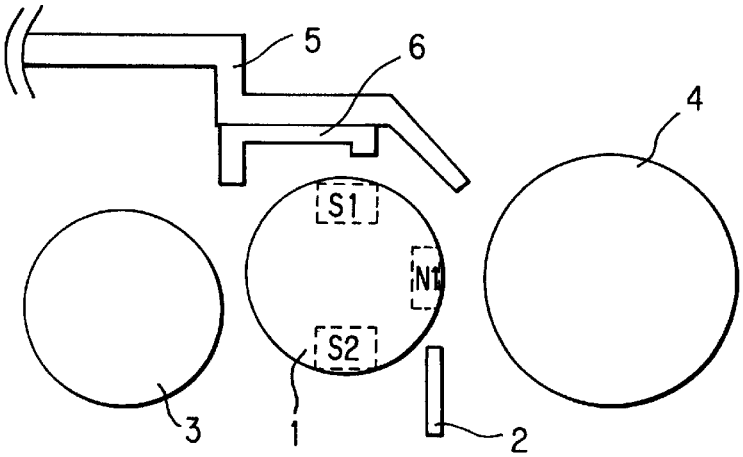
FIG. 18 is a sectional view showing mode 3 of the third embodiment of a developing device of the present invention.
Figure 19:
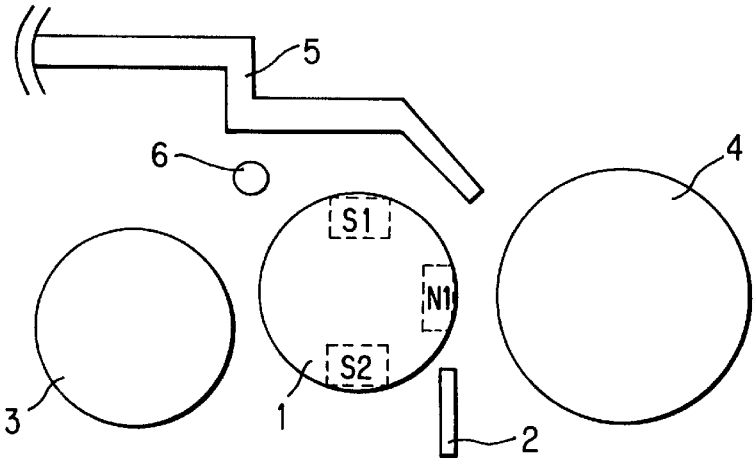
FIG. 19 is a sectional view showing mode 4 of the third embodiment of a developing device of the present invention.

FIG. 16 shows the first mode (mode 1) of the third embodiment, which includes a magnetic element 6 disposed opposing collecting magnetic pole S1 on the undersurface of casing 5 outside the developer flow path. FIG. 17 shows the second mode (mode 2) of the third embodiment, wherein a magnetic element 6 has its downstream end, with respect to the rotational direction of developer sleeve 1, extended downward so as not to interfere with the developer flow path, and a dual-component magnetic developer containing a carrier having a carrier diameter of 60 $\mu$m is used. FIG. 18 shows the third mode (mode 3) of the third embodiment, wherein a magnetic element 6 has both upstream and downstream ends, with respect to the rotational direction of developer sleeve 1, extended downward so as not to interfere with the developer flow path, and a dual-component magnetic developer containing a carrier having a carrier diameter of 80 $\mu$m is used. FIG. 19 shows the fourth mode (mode 4) of the third embodiment, wherein a cylindrical magnetic element 6 is arranged within, and on the downstream side of, the magnetic field of collecting magnetic pole S1 outside the developing flow path and a dual-component magnetic developer containing a carrier having a carrier diameter of 37 $\mu$m is used.

The developing devices of modes 1 to 4 of the third embodiment were set to an image forming apparatus (a digital copier AL-1000: a product of Sharp Kabushiki Kaisha) and were tested as to printing endurance and the evaluation result of the test is shown in FIG. 20. Mode 1—1 represents a configuration using a dual-component magnetic developer containing a carrier having a carrier diameter of 37 $\mu$m; and Mode 1–2 represents a configuration using a dual-component magnetic developer containing a carrier having a carrier diameter of 60 $\mu$m;

The print endurance test of the third embodiment shown in FIG. 20 was performed in the same manner as in the print endurance test of the first embodiment.

Figure 21:
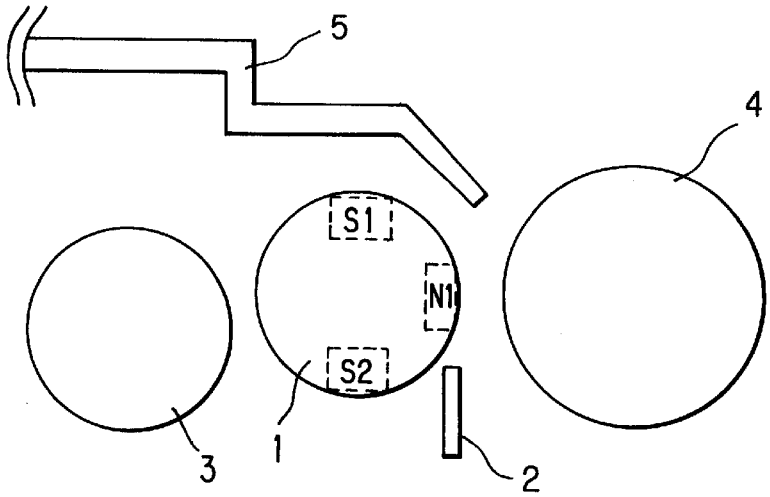
FIG. 21 is a sectional view showing a comparative example 1 compared to the third embodiment of a developing device of the present invention.
Figure 22:
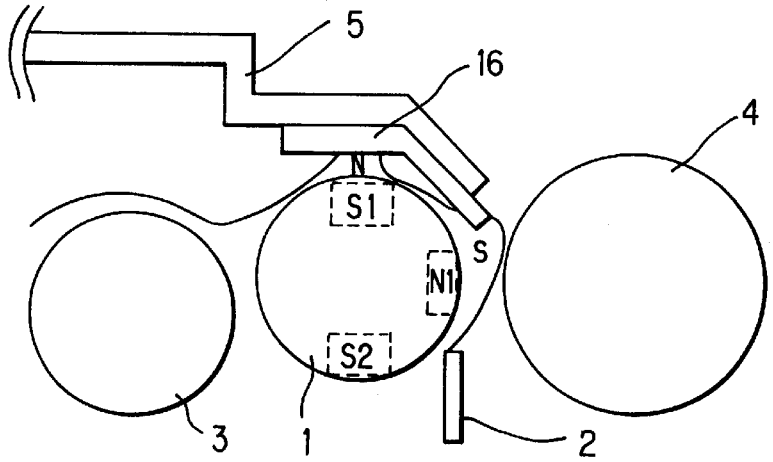
FIG. 22 is a sectional view showing a comparative example 2 compared to the third embodiment of a developing device of the present invention.
Figure 23:
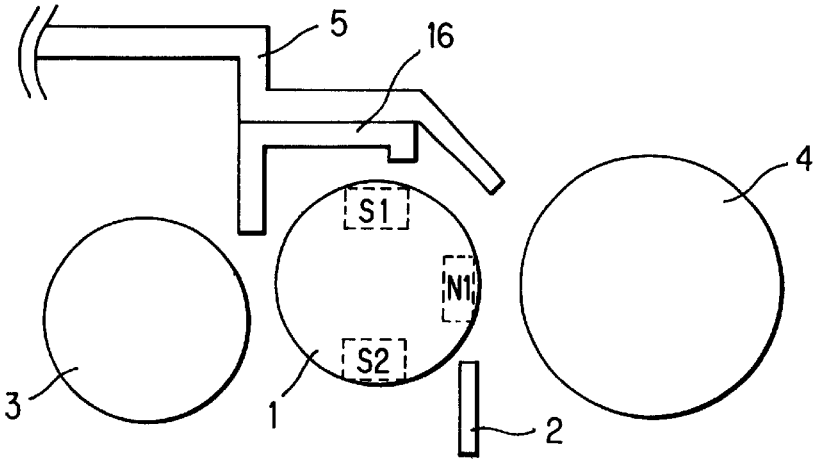
FIG. 23 is a sectional view showing a comparative example 3 compared to the third embodiment of a developing device of the present invention.

Comparative examples 1 to 4 in FIG. 20 are examples to be compared to modes 1 to 4 of the third embodiment. Comparative examples 1—1 and 1–2 are configurations shown in FIG. 21, having no magnetic element, wherein a dual-component magnetic developer containing a carrier having a carrier diameter of 37 $\mu$m was used and wherein a dual-component magnetic developer containing a carrier having a carrier diameter of 80 $\mu$m was used, respectively. Comparative example 2 is a configuration shown in FIG. 22, having a magnetic element 16 with its upstream end, with respect to the rotational direction of developer sleeve 1, extended to the proximity of photoreceptor drum 4 where the magnetic field of development magnetic pole N1 is effective. Comparative example 3 is a configuration shown in FIG. 23 where a magnetic element 16 has its upstream end, with respect to the rotational direction of developer sleeve 1, extended toward developer sleeve 1 surface and its downstream end extended to a position inside the developer flow path where developer sleeve 1 and agitating roller 3 oppose each other. Comparative example 4 has the same configuration as mode 1 of the first embodiment, wherein a dual-component magnetic developer containing a carrier having a carrier diameter of 32 $\mu$m was used.

As understood from FIG. 20, all modes 1 to 4 of the third embodiment presented beneficial results, whereas comparative examples 1 to 4 had the problems of toner density lowering, toner aggregation, toner filming and/or adherence of external additives onto the toner surface.

In the case of a developer containing a carrier having a carrier diameter greater than 80 $\mu$m, it is possible to remove the developer without using the configuration of the third embodiment because of the largeness of the carrier particles. In the case of a developer containing a carrier having a carrier diameter below 37 $\mu$m, the removal performance of the developer is lowered because of a high density of the developer. Therefore, when developers containing a carrier having a carrier diameter ranging from 37 to 80 $\mu$m are used, it is possible to maximize the removal performance of the developer.

(The fourth embodiment)

The developing devices of the fourth embodiment use magnetic developers having a retention force of 10 to 30 (Oe) under an external magnetic field of 5 (Oe). Developing devices in modes 1 to 4 of the fourth embodiment are the same as those of mode 1 to 4 of the third embodiment shown in FIGS. 16 to 19.

The developing devices of modes 1 to 4 of the fourth embodiment were set to an image forming apparatus (a digital copier AL-1000: a product of Sharp Kabushiki Kaisha) and were tested as to printing endurance and the evaluation result of the test is shown in FIG. 24. Mode 1—1 represents a configuration using a magnetic developer having a retention force of 16 (Oe). Mode 1–2 represents a configuration using a magnetic developer having a retention force of 30 (Oe). Mode 2 of the fourth embodiment represents a configuration using a magnetic developer having a retention force of 16 (Oe). Mode 3 of the fourth embodiment represents a configuration using a magnetic developer having a retention force of 25 (Oe). Mode 4 of the fourth embodiment represents a configuration using a magnetic developer having a retention force of 39 (Oe).

The print endurance test of the fourth embodiment shown in FIG. 24 was performed in the same manner as in the print endurance test of the first embodiment.

Comparative examples 1 to 4 in FIG. 24 are examples to be compared to modes 1 to 4 of the fourth embodiment and have the same configurations as the developing devices shown in comparative examples 1 to 4 of the third embodiment. Comparative example 1—1 is a configuration wherein a magnetic developer having a retention force 8 (Oe) was used. Comparative example 1–2 is a configuration wherein a magnetic developer having a retention force 16 (Oe) was used. Comparative example 2 is a configuration wherein a magnetic developer having a retention force 16 (Oe) was used. Comparative example 3 is a configuration wherein a magnetic developer having a retention force 30 (Oe) was used. Comparative example 4 is a configuration wherein a magnetic developer having a retention force 41 (Oe) was used.

As understood from FIG. 24, all modes 1 to 4 of the fourth embodiment presented beneficial results, whereas comparative examples 1 to 4 had the problems of toner density lowering, toner aggregation, toner filming and/or adherence of external additives over the toner surface.

Developers having a retention force Hc of 10 to 30 (Oe) are of an iron powder developer, which usually makes it hard to separate the particles and remove them from the developer sleeve. However, the synergistic effect of the repulsive magnetic field and the magnetic field of the magnetic element as in the fourth embodiment, enables easy separation and removal of the developer even if it is of an iron powder developer having a retention force Hc of 10 to 30 (Oe).

According to the developing device of the first feature of the invention, a magnetic field approximately perpendicular to the developer conveying direction on the developer support surface is formed between the developer conveyance magnetic pole and the magnetic element so as to produce a speed differential within the moving developer layer. As a result it is possible to agitate the developer along the direction perpendicular to the developer conveying direction and hence promote separation of the developer so as to separate the developer from the developer support, thus leading to easy circulation of the developer. Further, since the magnetic element is arranged outside the developer flow path, there is no stress acting on the developer. As a result, it is possible to prevent the problems of developer aggregation, filming of the developer over the developer support surface, toner filming over the carrier of the developer and external additives being missing from, or becoming embedded into, the toner surface of the developer. Thus, it is possible to provide a developing device which is compact and simple and still inexpensive and which can produce stable images with a uniform high density free from background fogging and toner scatter over a prolonged period of time.

According to the developing device of the second feature of the invention, it is possible to prevent the developer from going beyond the magnetized area of the developer conveyance magnetic pole, which would occur when the longitudinal dimension of the magnetic element is greater than the width of the developing conveyance magnetic pole (the dimension perpendicular to the developer conveyance direction), and hence it is possible to prevent the developer from entering the bearing portions at the ends of the developer support. Therefore it is possible to reliably avoid the occurrence of the problems of toner aggregation in the developer, toner scatter, developer dropping, the developing support being stuck and the like.

According to the developing device of the third feature of the invention, since the reproduction (development) of the static latent will not be disturbed by the influence of the magnetic field of the magnetic element, it is possible to reliably prevent the problems of the image density lowering, background fogging, density unevenness, character voids etc.

According to the developing device of the fourth feature of the invention, since no stress acting on the developer will occur, it is possible to reliably prevent the problems of toner aggregation in the developer, toner filming over the developer support surface, toner filming over the carrier surface of the developer and external additives being missing from, or becoming embedded into, the toner surface.

According to the developing device of the fifth feature of the invention, it is possible to reliably remove the developer from the developer support by virtue of synergistic effect of the repulsive magnetic field and the magnetic field of the magnetic element, thus facilitating circulation of the developer.

According to the developing device of the sixth through ninth features of the invention, a magnetic field approximately perpendicular to the developer conveying direction on the developer support surface is formed between the developer conveyance magnetic pole and the magnetic element so as to produce a speed differential within the moving developer layer. As a result it is possible to agitate the developer along the direction perpendicular to the developer conveying direction and hence promote separation of the developer so as to separate the developer from the developer support without generating any stress on the developer, thus facilitating circulation of the developer.

What is claimed is:

1. A developing device comprising:

a magnetic assembly having multiple magnetic poles fixed at predetermined positions;

a developer support which rotatably encloses the magnetic assembly to convey and support a developer layer on a surface thereof by magnetism of the magnetic assembly;

a regulating element for regulating a thickness of the developer layer supported on the developer support surface; and a rotational agitator disposed adjacent to the developer support to receive developer from the developer support and supply the developer to the surface of the developer support, wherein the developer support, as it rotates, supplies and develops a static latent image on a static latent image bearer using the developer supplied from the developer support, wherein a magnetic element is separated from the regulating element and arranged opposing the developer support and is outside a flow path of the developer.

2. The developing device according to claim 1, wherein a longitudinal dimension, perpendicular to a developer conveying direction, of the magnetic element is less than a magnetized width of a developer conveyance magnetic pole of the magnetic assembly.

3. The developing device according to claim 1, wherein the magnetic element is arranged away from a magnetic influence of a magnetic field of a development magnetic pole of the magnetic assembly.

4. The developing device according to claim 1, wherein the magnetic element is arranged out of contact with the developer circulating inside the developing device.

5. The developing device according to claim 1, wherein the developer is a dual-component magnetic developer including a toner and magnetic carrier having a carrier particle size ranging from 37 to 80 $\mu$m.

6. The developing device according to claim 1, wherein the developer is a magnetic developer having a retention force Hc in the range of 10 to 30 Oe when an external magnetic field of 5 KOe is applied.

7. The developing device of claim 1, wherein said rotational agitator is a cylindrical roller.

8. The developing device of claim 1, wherein said magnetic assembly further comprises:

a collecting magnetic pole and a conveyance magnetic pole each having a same polarity and arranged diametrically opposed to each other along an inner periphery of said developer support; and a development magnetic pole having an opposite polarity to the polarity of said collecting and said conveyance magnetic poles, said development magnetic pole being arranged along the inner periphery of said developer support at a position intermediate to said collecting magnetic pole and said conveyance magnetic pole.

9. The developing device of claim 8, wherein said development magnetic pole is disposed directly opposed to a photoreceptor drum.

10. The developing device of claim 8, wherein said collecting magnetic pole is positioned downstream of said development magnetic pole and said conveyance magnetic pole is positioned upstream of said development pole with respect to the flowpath of the developer.

11. The developing device of claim 8, wherein said magnetic assembly further comprises:

a repulsive magnetic pole arranged adjacent to said collecting magnetic pole and having the same polarity as said collecting magnetic pole; and a magnetic pole located upstream of said conveyance magnetic pole with respect to the flowpath of the developer and having a polarity opposite to the polarity of said conveyance magnetic pole.

12. The developing device of claim 1, wherein said magnetic element is located in a groove on an outer side of a casing opposed to the developer support so as to completely separate the magnetic element from any contact with the developer.

13. The developing device of claim 1, wherein said magnetic element is thicker on a downstream side with respect to the flowpath of the developer.

14. A developing device comprising:

a magnetic assembly having multiple magnetic poles fixed at predetermined positions;

a developer support which rotatably encloses the magnetic assembly to convey and support a developer layer on a surface thereof by magnetism of the magnetic assembly;

a regulating element for regulating a thickness of the developer layer supported on the developer support surface; and a rotational agitator disposed adjacent to the developer support to receive developer from the developer support and resupply the developer to the surface of the developer support, wherein the developer support, as it rotates, supplies and develops a static latent image on a static latent image bearer using the developer supplied from the developer support, the magnetic assembly having a pair of magnetic poles of the same polarity forming a repulsive magnetic field on a downstream side with respect to a rotational direction of the developer support, wherein a magnetic element is separated from the regulating element and arranged opposing the developer support.

15. The developing device according to claim 14, wherein the developer is a dual-component magnetic developer including a toner and magnetic carrier having a carrier particle size ranging from 37 to 80 $\mu$m.

16. The developing device according to claim 14, wherein the developer is a magnetic developer having a retention force Hc in the range of 10 to 30 Oe when an external magnetic field of 5 KOe is applied.

17. The developing device of claim 14, wherein said rotational agitator is a cylindrical roller.

18. The developing device of claim 14, wherein a longitudinal dimension of the magnetic element perpendicular to a developer flow direction is less than a magnetized width of a conveyance magnetic pole of the magnetic assembly.

19. The developing device of claim 14, wherein said magnetic element is located in a groove on an outer side of a casing so as to be completely separated from any contact with the developer.

20. A developing device, comprising:

a magnetic assembly having a plurality of magnetic poles located at predetermined positions;

a developer support which rotates around the magnetic assembly to convey and support a developer layer on a surface thereof by a magnetic attraction of the magnetic assembly;

a regulating element to regulate a thickness of the developer layer on the developer support;

a rotating agitator disposed adjacent to the developer support to receive developer from the developer layer and to resupply developer to the surface of the developer support; and a magnetic element separated from the regulating element and arranged opposing the developer support and outside a flow path of the developer, wherein a longitudinal dimension of the magnetic element perpendicular to a developer flow direction is less than a magnetized width of a conveyance magnetic pole of the magnetic assembly.

* * * * *